United States Patent [19]

Eidinger et al.

[11] Patent Number: 4,960,165

[45] Date of Patent: Oct. 2, 1990

[54] METHOD AND APPARATUS FOR ADJUSTING A MOLD DURING CASTING IN A CONTINUOUS METAL CASTING PROCESS

[75] Inventors: Helmut Eidinger, Schoenering; Werner Scheurecker, Linz, both of Austria

[73] Assignee: Voest-Alpine Industrieanlagenbau Gesellschaft mbH, Linz, Austria

[21] Appl. No.: 433,312

[22] Filed: Nov. 8, 1989

[30] Foreign Application Priority Data

Nov. 9, 1988 [DE] Fed. Rep. of Germany ..... 3838010

[51] Int. Cl.[5] ..... B22D 11/04

[52] U.S. Cl. ..... 164/491; 164/436

[58] Field of Search ..... 164/436, 491, 452, 154

[56] References Cited

FOREIGN PATENT DOCUMENTS 59-29344 7/1984 Japan ..... 164/436

*Primary Examiner*—Kuang Y. Lin

*Attorney, Agent, or Firm*—Townsend and Townsend

[57] ABSTRACT

A method for adjusting the casting width of a continuous metal, in particular steel, casting mold in which two displaceable end walls are clamped between two large side walls with a predetermined clamping force. Prior to making the adjustment the clamping force acting on the end walls is released and one large side wall is displaced away from the abutting end walls to form a gap between them so that the end walls can be moved to the desired position. They are then clamped again between the two side walls. To attain an optimum gap width between the end and side walls by taking the actual mold dimensions at the time of adjustment into consideration, the thermal expansion of the end walls in a direction parallel to the axis of the tie rods is measured during casting, or at least during the start-up period of the continuous casting process until it has reached its equilibrium state. The adjustment is the made by adding the desired, optimum gap width to the actual, measured expansion of the end walls.

6 Claims, 1 Drawing Sheet

METHOD AND APPARATUS FOR ADJUSTING A MOLD DURING CASTING IN A CONTINUOUS METAL CASTING PROCESS

BACKGROUND OF THE INVENTION

The invention relates to adjusting the casting cross-section of a continuous metal, in particular steel, casting mold. In such a mold two movable small end walls are clamped between two large side walls with a predetermined clamping force. Just prior to the adjustment the clamping force acting on the end walls is released and one of the large side walls is moved away from its abutment with the end wall. Thereafter the end walls are repositioned and they are then clamped again between the two side walls. Further, the invention relates to an apparatus for adjusting the casting cross-section of a continuous metal, in particular steel, casting mold. It comprises two large side walls inserted in a water tank and two smaller end walls which are clamped between the side walls. The small end walls are movable relative to one another for adjusting the casting cross-section of the mold formed by the side and end walls. The ends of the large side walls are pressed against the end walls by means of at least one clamping device comprised of a spring pack, a tie rod connected to both side walls, and an associated, releasable actuator.

The adjustment of the cross-section of casting molds during continuous metal casting as such is known. In the past the end walls were clamped between the large side walls. To make an adjustment the clamping force, e.g. generated by a fluid actuator, was released to create a gap between the end and side walls to enable a displacement of the end walls relative to the side walls. Such arrangements are disclosed in European patent publication No. EP-P 19 974, Austrian patent No. AT-P 334 304 and German patent No. DE 36 40 096. The last cited reference discloses a method and apparatus of the type referred to above. It employs stops against which the large side walls can be moved to open up a predetermined gap.

The optimal gap width is limited to a very narrow range. If, for instance, the gap is too narrow or if there is no gap at all, i.e. if the clamping force between the side and end walls is merely released, excessive wear is encountered and severe damage may result to the inner plate surfaces of the side walls. If on the other hand the gap is too wide fluid melt can penetrate into the gap between the side and end walls. Both cases can adversely affect the casting operation. If the gap is conventionally fixed by positioning stops for the side walls in accordance with past experience the casting operation runs smoothly so long as the operation is trouble-free. When variations occur in the molding process, for example, as a result of fluctuating melting temperatures, varying cooling conditions inside the casting mold or variations in the rate of pouring, corresponding variations in the thermal expansion of the casting mold occur. This leads to corresponding fluctuations in the distance between the side walls and thereby also in the actual size of the gap between the end and side walls of the mold.

SUMMARY OF THE INVENTION

It is therefore an object of the present invention to eliminate these drawbacks and to provide a method and a casting mold for setting a gap between the end and side walls of optimal size as a function of the actual mold geometry at the time of the adjustment.

This is achieved by measuring the thermal expansion of the end walls in a direction parallel to the axis of the tie rod during the casting operation or at least during the start-up period until full operation has been attained. The side walls are then moved apart by an amount which will generate a gap of the desired predetermined size.

The measured expansion values are advantageously fed to a calculating means and the instantaneous, actual spacing between the large side walls at the time of the adjustment, which is based on the initial setting of the mold, is determined. The calculating means adds to the actual spacing between the large side walls the desired, predetermined width of the gap to calculate the required distance the large side walls are to be moved, or to calculate the position to which they are to be moved.

It has proven especially advantageous to move the large side walls apart a distance of between about 0.1 to 0.3 mm.

The casting mold of the present invention is characterized in that at least one position sensor for the tie rods is in signal communication with the calculating means, and in that the calculating means is in signal communication with a control device which in turn activates an actuator.

In a particularly efficient embodiment the control device is a valve and the actuator is a pressurized fluid actuator. The calculating means is preferably a microprocessor.

BRIEF DESCRIPTION OF THE DRAWINGS

An embodiment of the present invention is described in greater detail with reference to the following drawings; in which.

DESCRIPTION OF THE PREFERRED EMBODIMENTS

Figure 1:
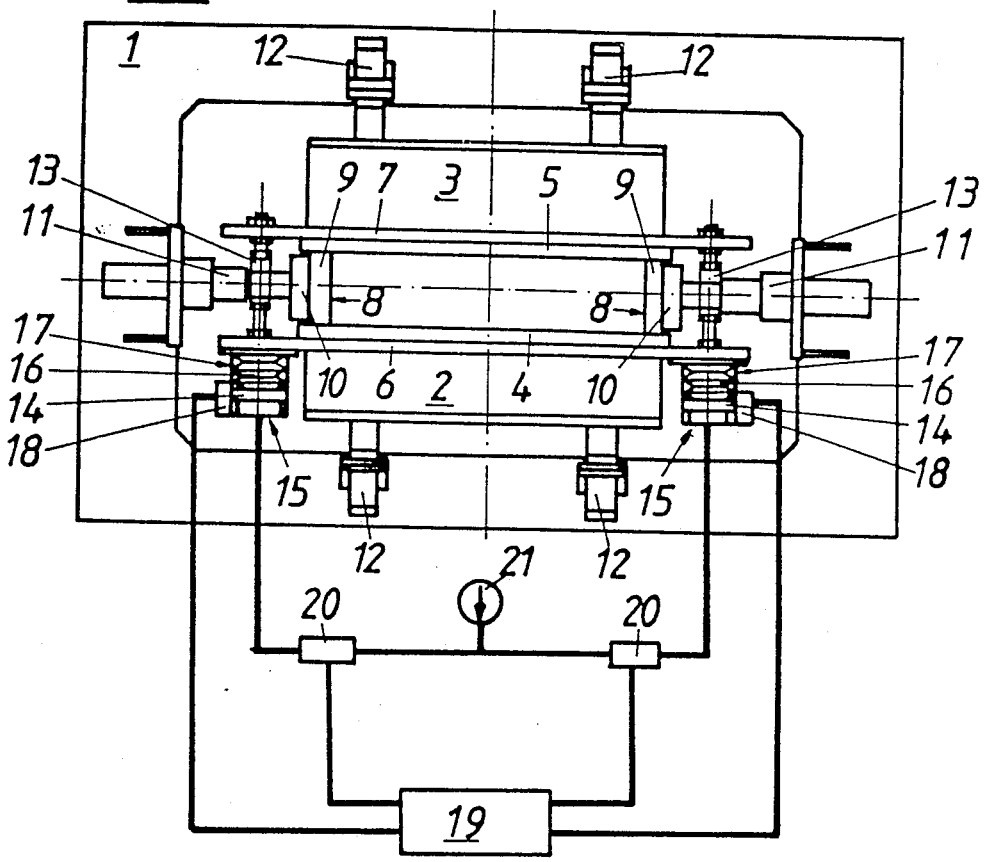
FIG. 1 is a plan view of a continuous metal casting mold and schematically illustrates a displacement means.

FIG. 1 shows a casting mold support frame 1 which defines a water tank. Large side walls 2,3 of the casting mold are inserted in the tank and supported by it. Each of the side walls has internally-cooled, inner copper plates 4,5 mounted to support plates 6,7 which are in turn affixed to walls 2,3. Small end walls 8 also have internally-cooled copper-plates 9 mounted on support plates. To vary the mold dimensions threaded spindles coupled to a drive 11 move each of the two walls 8 parallel or into different inclinations. Water necessary for cooling the copper-plates of large side walls 2,3 is supplied via connectors 12 which are in fluid communication with water tank 1. The water supply for the copper plates (9) of the end walls 8 is not illustrated.

Mounted at the lateral ends of and projecting through the support plates 6,7 of the large side walls 2,3 are tie rods 13 which are preferably adjustable with turn buckles or the like. One end of each tie rod is connected to a piston 14 of an actuator 15 preferably in the form of a pressurized fluid, e.g. hydraulic actuator. Disposed between piston 14 and support plate 6 of each tie rod is a clamp defined by a pack of springs 17 which generate a clamping force that biases the side walls 2,3 against the end walls 8.

Thermal elongations acting parallel to the axis of the tie rods are detected by a position sensor or transducer 18 which is part of a control device 15 and which continuously monitors the position of piston 14 during the metal casting operation. Position responsive signals from it are fed from the sensor to a calculating means or computer 19. The computer is in turn in signal communication with a control device defined by a regulating valve 20 which modulates the flow of hydraulic fluid from a pump 21 to control device 15.

Position sensor 18, computer 19 and regulating valves 20 cooperate to permit a sufficient hydraulic fluid flow through valves 20 to position the side plates where the desired gap width is attained. Once regulating valve 20 is closed and the displacement phase is completed, the valve is reopened. End walls 8 thereby become again automatically clamped between the side walls 2,3.

If desired, a mechanically-powered system can be substituted for the above disclosed hydraulic system. In this case the control device will typically be an electric motor while the actuator will be a threaded spindle which is driven by the motor.

Figure 2:
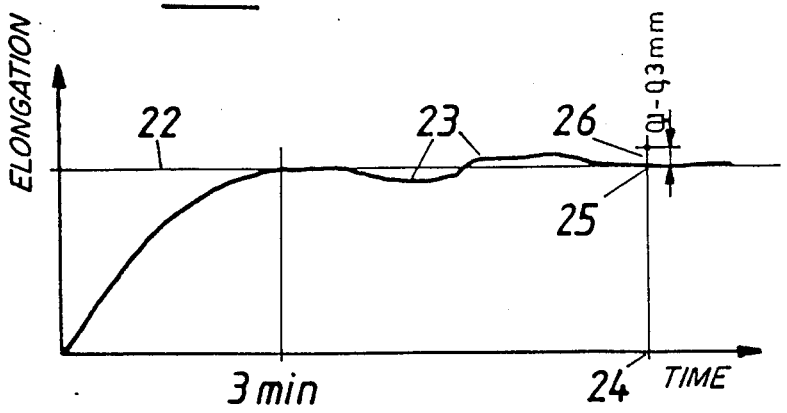
FIG. 2 is a graph representing the expansion as a function of time from the onset of casting to the point when the process has stabilized.

FIG. 2 shows the extent of expansion parallel to the axis of the tie rods from the onset of pouring. After about 3 minutes a standard expansion value 22 is attained which is typical for a given continuous, trouble-free casting process. Any short-term or long-term fluctuations which may occur as a result of differences in the melting temperature, outside temperature, cooling of the casting mold and/or the rate of pouring will produce deviations 23 from the standard value. These deviations will affect the positionally fixed pouring gap and bring with it the drawbacks cited above. At a particular point (24) during the casting process when the mold width has to be adjusted, the desired, predetermined gap width is added to the actual spacing between the plates and a corresponding adjustment is made. Thus, the casting process of the present invention remains unaffected by the fluctuations that are normally encountered in a continuous casting process.

What is claimed is:

1. A method for adjusting a mold during a continuous metal casting process, the mold having first and second, relatively smaller end walls clamped between first and second, relatively larger side walls by biasing the side walls with a predetermined clamping force against the end walls, the mold being adjusted by moving the end walls to a desired casting width, the method comprising the steps of measuring the thermal expansion of the end walls during at least the start-up period of the continuous casting process, storing a measured expansion value, releasing the clamping force, thereafter moving the large side walls away from each other to form a gap of predetermined width between the thermally expanded end walls and the side walls, thereafter moving the end walls to the desired casting width, and thereafter re-applying the predetermined clamping force to the larger side walls.

2. A method as claimed in claim 1, including the steps of applying measured expansion values to a calculating means, with the calculating means determining the instantaneous spacing between the larger side walls from the expansion values and the initial width of the end walls of the cold mold, with the calculating means calculating a desired position to which the larger side walls are to be moved by adding to the instantaneous expansion value the desired width of the gap, and moving the larger side walls to the calculated desired position so that there is a gap of the desired width between the end walls and the side walls to facilitate the movement of the end walls to obtain the desired casting width.

3. A method according to claim 2, wherein the 1 predetermined gap width is between about 0.1 to 0.3 mm.

4. An apparatus for adjusting the casting width of a continuous metal casting mold comprising, a rectangular mold having first and second, relatively smaller end walls disposed between first and second relatively larger side walls, means for moving the end walls to adjust the casting width, clamping means for releasably applying a predetermined clamping force to the side walls and clamping the smaller end walls therebetween, displacement means for moving the larger side walls away from the smaller end walls when the clamping force has been released, sensor means for continuously detecting.. changes in the spacing between the larger side walls, calculating means connected to the sensor means for calculating the instantaneous spacing between the larger side walls and for calculating a release position of the larger side walls by adding a predetermined gap width to the instantaneous spacing, and control means connected to the calculating means for activating and controlling the displacement means to move the larger side walls into the release position.

5. An apparatus as claimed in claim 4, wherein the clamping means comprise tie- rods connecting the larger side walls, tensioning spring means acting on the tie rods and generating the clamping force, and fluid operated piston means for selectively applying or releasing the clamping force on the tie rods, and wherein the sensor means includes a position detector operatively associated with the clamping means.

6. Apparatus according to claim 4, wherein the calculating means comprises a microprocessor.

* * * * *

US004960165B1

REEXAMINATION CERTIFICATE (2228th)

United States Patent [19]

[11] B1 4,960,165

Eidinger et al.

[45] Certificate Issued Feb. 22, 1994

[54] METHOD AND APPARATUS FOR ADJUSTING A MOLD DURING CASTING IN A CONTINUOUS METAL CASTING PROCESS

[75] Inventors: Helmut Eidinger, Schoenering; Werner Scheurecker, Linz, both of Austria

[73] Assignee: Voest-Alpine Industrieanlagenbau Gesellschaft m.b.H, Linz, Austria

Reexamination Request:
No. 90/002,899, Dec. 2, 1992

Reexamination Certificate for:

| | |
|---|---|
| Patent No.: | **4,960,165** |
| Issued: | **Oct. 2, 1990** |
| Appl. No.: | **433,312** |
| Filed: | **Nov. 8, 1989** |

[30] Foreign Application Priority Data

Nov. 9, 1988 [DE] Fed. Rep. of Germany ..... 3838010

[51] Int. Cl.[5] ..... B22D 11/04; B22D 11/16
[52] U.S. Cl. ..... 164/491; 164/436
[58] Field of Search ..... 164/436, 491, 154, 452

[56] References Cited

U.S. PATENT DOCUMENTS

| | | |
|---|---|---|
| 3,964,727 | 6/1976 | Gladwin . |
| 4,006,633 | 2/1977 | Shipman et al. . |
| 4,105,059 | 8/1978 | Ohnishi et al. . |
| 4,487,249 | 12/1984 | Wrhen . |

*Primary Examiner*—K. Y. Lin

[57] ABSTRACT

A method for adjusting the casting width of a continuous metal, in particular steel, casting mold in which two displaceable end walls are clamped between two large side walls with a predetermined clamping force. Prior to making the adjustment the clamping force acting on the end walls is released and one large side wall is displaced away from the abutting end walls to form a gap between them so that the end walls can be moved to the desired position. They are then clamped again between the two side walls. To attain an optimum gap width between the end and side walls by taking the actual mold dimensions at the time of adjustment into consideration, the thermal expansion of the end walls in a direction parallel to the axis of the tie rods is measured during casting, or at least during the start-up period of the continuous casting process until it has reached its equilibrium state. The adjustment is then made by adding the desired, optimum gap width to the actual, measured expansion of the end walls.

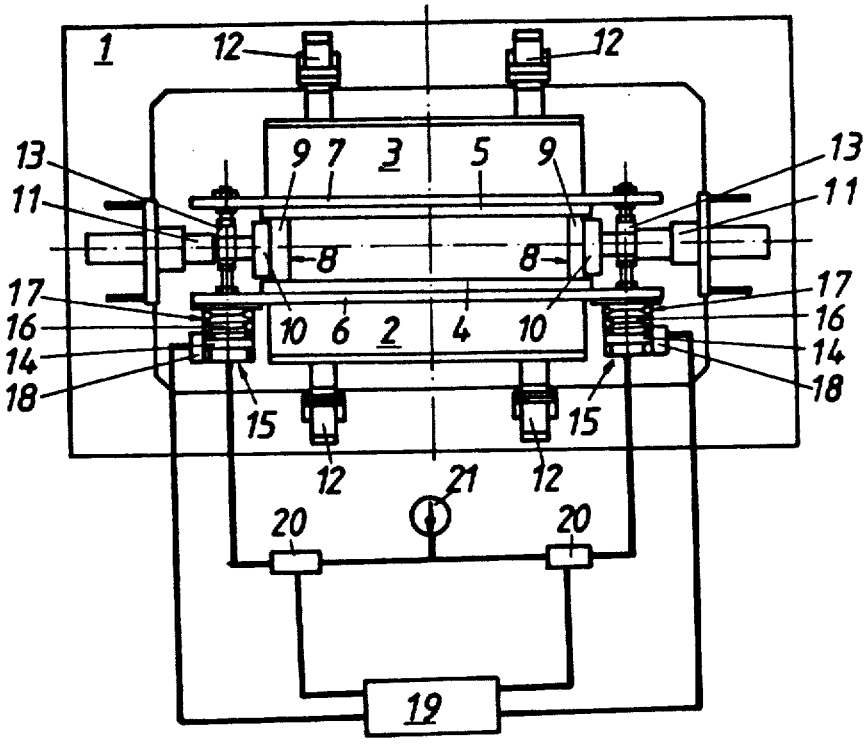

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Col. 1, lines 29–42.

The adjustment of the cross-section of casting molds during continuous metal casting as such is known. In the past the end walls were clamped between the large side walls. To make an adjustment the clamping force, e.g. generated by a fluid actuator, was released to create a gap between the end and side walls to enable a displacement of the end walls relative to the side walls. Such arrangements are disclosed in European patent publication No. EP-P [19 974] *107 564*, Austrian patent No. AT-P 334,403 and German patent No. DE 36 40 096. The last cited reference discloses a method and apparatus of the type referred to above. It employs stops against which the large side walls can be moved to open up a predetermined gap.

Col. 1, lines 43–63.

The optimal gap width is limited to a very narrow range. If, for instance, the gap is too narrow or if there is no gap at all, i.e. if the clamping force between the side and end walls is merely released, excessive wear is encountered and severe damage may result to the inner plate surfaces of the side walls. If on the other hand the gap is too wide fluid melt can penetrate into the gap between the side and end walls. Both cases can adversely affect the casting operation. If the gap is [conventionally fixed] *provided in the known manner* by positioning stops for the side walls in accordance with past experience the casting operation runs smoothly so long as the operation is trouble-free. When variations occur in the molding process, for example, as a result of fluctuating melting temperatures, varying cooling conditions inside the casting mold or variation in the rate of pouring, corresponding variations in the thermal expansion of the casting mold occur. This leads to corresponding fluctuations in the distance between the side walls and thereby also in the actual size of the gap between the end and side walls of the mold.

AS A RESULT OF REEXAMINATION, IT HAS BEEN DETERMINED THAT:

Claims 1-5 are determined to be patentable as amended.

Claim 6 dependent on an amended claim is determined to be patentable.

New claims 7 and 8 are added and determined to be patentable.

1. A method for adjusting a mold during a continuous metal casting process, the mold having first and second, relatively smaller end walls clamped between first and second, relatively larger side walls by biasing the side walls with a predetermined clamping force against the end walls, the mold being adjusted by *relieving the clamping force and* moving the end walls to a desired casting width, the method comprising the steps of:

*continuously* measuring *a momentary position of the side walls as determined by* the thermal expansion of the end walls during at least the start-up period of the continuous casting process *and while the clamping force is applied*[,] ;

storing [a] *the* measured [expansion] *momentary position* [value,] *of the side walls;* releasing the clamping force[,] ;

thereafter moving the [large] side walls away from each other *to a displaced position which is displaced from said stored measured momentary by an amount such as* to form a gap of predetermined width between the thermally expanded end walls and the side walls[,] ;

thereafter moving the end walls to the desired casting width[,] ; and thereafter re-applying the predetermined clamping force to the larger side walls.

2. A method as claimed in claim 1, including the steps of applying *the* measured [expansion values] *position* to a calculating means, with the calculating means determining the instantaneous spacing between the larger side walls from the [expansion values] *measured position* and the initial width of the end walls of the cold mold, with the calculating means calculating a desired position to which the larger side walls are to be moved by adding *said amount* to the [instantaneous expansion value the desired width of the gap] *measured position*, and moving the larger side walls to [the calculated] *said* desired position so that there is [a] *the* gap of the [desired] *predetermined* width between the end walls and the side walls to facilitate the movement of the end walls to obtain the desired casting width.

3. A method according to claim 2, wherein the [1] predetermined gap width is between about 0.1 to 0.3 mm.

4. An apparatus for adjusting the casting width of a continuous metal casting mold comprising[,] ;

a rectangular mold having first and second, relatively smaller end walls disposed between first and second relatively larger side walls[,] ;

means for moving the end walls to adjust the casting width[,] ;

clamping means for releasably applying a predetermined clamping force to the side walls and clamping the smaller end walls therebetween[,] ;

displacement means for moving the larger side walls away from the smaller end walls when the clamping force has been released[,] ;

sensor means for continuously detecting[..] changes in the spacing between the larger side walls[,] ;

calculating means connected to the sensor means for calculating the instantaneous spacing between the larger side walls and for calculating a release position of the larger side walls by adding a predetermined gap width to the instantaneous spacing[,] ; and control means connected to the calculating means for activating and controlling the displacement means to move the larger side walls into the release position.

5. An apparatus as claimed in claim 4, wherein the clamping means comprise tie[-] rods connecting the larger side walls, tensioning spring means acting on the tie rods and generating the clamping force, and fluid operated piston means for selectively applying or releasing the clamping force on the tie rods, and wherein the sensor means includes a position detector operatively associated with the clamping means.

*7. A method for adjusting a mold during a continuous metal casting process, the mold having first and second, relatively smaller end walls disposed between first and second, relatively larger side walls biased against the end walls with a predetermined clamping force, the method comprising the steps of:*

*continuously measuring a spacing of the side walls during at least the start-up period of the continuous casting process and while the clamping force is applied so that thermal expansions and contractions of the end walls during the casting process are detected;*

*storing at least the most recently measured side wall spacing;*

*releasing the clamping force;*

*thereafter adjusting the side wall spacing from the most recently measured spacing by a predetermined amount to form a gap between ends of the end walls and the side walls of a width which equals said predetermined amount;*

*thereafter moving the end walls to the desired width of the casting; and*

*thereafter reapplying the predetermined clamping force to the side walls to close the gap.*

*8. Apparatus for adjusting the casting width of a continuous metal casting mold comprising:*

*a rectangular mold having first and second, relatively smaller end walls disposed between first and second, relatively larger side walls;*

*means for moving the end walls to adjust the casting width;*

*clamping means for releasably applying a predetermined clamping force to the side walls and clamping the end walls therebetween;*

*displacement means for moving the side walls away from the end walls when the clamping force has been released;*

*sensor means for continuously detecting thermally induced changes in the length of the end walls;*

*calculating means operatively coupled to the sensor means for adding to the sensed length of the end walls a predetermined gap width to thereby establish a release position for the side walls; and*

*control means coupled to the calculating means for activating the displacement means and therewith moving the side walls into their release positions so that the position of the end walls can be adjusted without friction between them and the side walls while said gap of predetermined width is maintained.*

* * * * *